US008730108B2

(12) United States Patent
Huang et al.

(10) Patent No.: US 8,730,108 B2
(45) Date of Patent: May 20, 2014

(54) MULTI-BAND ANTENNA

(75) Inventors: Yi-Feng Huang, New Taipei (TW); Jia-Hung Su, New Taipei (TW); Kai Shih, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 223 days.

(21) Appl. No.: 13/490,627

(22) Filed: Jun. 7, 2012

(65) Prior Publication Data

US 2013/0328728 A1 Dec. 12, 2013

(51) Int. Cl.
*H01Q 1/38* (2006.01)
*H01Q 1/24* (2006.01)

(52) U.S. Cl.
USPC ..... 343/700 MS; 343/702

(58) Field of Classification Search
CPC ..... H01Q 1/24; H01Q 1/243; H01Q 9/42
USPC ..... 343/700 MS, 702
See application file for complete search history.

(56) References Cited

U.S. PATENT DOCUMENTS 6,819,287 B2 * 11/2004 Sullivan et al. ..... 343/700 MS
7,924,230 B2 * 4/2011 Hung et al. ..... 343/702
7,932,861 B2 * 4/2011 Hung et al. ..... 343/700 MS
8,451,177 B2 * 5/2013 Shau et al. ..... 343/700 MS

* cited by examiner

*Primary Examiner* — Tan Ho

(57) ABSTRACT

A multi-band antenna includes a base portion, a substantially lying U-shaped first radiating portion, a substantially lying L-shaped second radiating portion and a third radiating portion. A rear edge of the base portion extends rearward to form a ground portion with a ground point being defined thereon. A top of the base portion defines a feeding point. The first radiating portion of which one end is connected with a first side edge of the base portion and the mouth faces to the first side edge of the base portion. The second radiating portion is connected with a second side edge of the base portion. The third radiating portion tortuously extends downward from a front edge of the base portion, then extends transversely, and further circuitously extends rearward to be located substantially near under a free arm of the second radiating portion.

6 Claims, 1 Drawing Sheet

MULTI-BAND ANTENNA

BACKGROUND OF THE INVENTION

1. Field of the Invention

The present invention relates to a multi-band antenna, and more particularly to a built-in multi-band antenna capable of being assembled in a portable mobile communication device.

2. The Related Art

In recent years, with the rapid development of mobile communication technology, portable mobile communication devices, such as cell phones and notebooks, need be developed faster and faster to meet overgrowing requirements of people. It's a trend for the portable mobile communication device to operate in multiple wireless wide area network systems covering different frequency ranges so as to keep a good communication performance anywhere. Accordingly, a multi-band antenna is needed to be assembled in the portable mobile communication device. However, the built-in multi-band antenna which is common-used, such as a planar inverted-F antenna (PIFA), has a complex structure, a larger volume and a higher manufacture cost. Consequently, utilization ratio of the common-used multi-band antenna is lower due to limitations of the complex structure, the larger volume and the higher manufacture cost of the multi-band antenna.

In consideration of the portable mobile communication device being developed towards a miniaturized direction, an innovative built-in multi-band antenna should be designed to have a simplified structure and a smaller volume in order to be conveniently assembled in the portable mobile communication device for remedying the defects of the common-used multi-band antenna and lower a manufacture cost of the multi-band antenna.

SUMMARY OF THE INVENTION

An object of the present invention is to provide a multi-band antenna. The multi-band antenna includes a base portion, a substantially lying U-shaped first radiating portion, a substantially lying L-shaped second radiating portion and a third radiating portion. The base portion has a rear edge, a front edge parallel to the rear edge, and a first side edge and a second side edge respectively connected between the rear edge and the front edge. One side of the rear edge of the base portion extends rearward to form a ground portion with a ground portion being defined thereon. A top of the base portion defines a feeding point. One end of the substantially lying U-shaped first radiating portion is connected with a rear end of the first side edge of the base portion and the mouth of the first radiating portion faces to the first side edge of the base portion. The substantially lying L-shaped second radiating portion is connected with a front end of the second side edge of the base portion with a free arm thereof extending rearward. The third radiating portion tortuously extends downward from the front edge of the base portion, then extends transversely to be located substantially in front of the other arm of the second radiating portion, and further circuitously extends rearward to be located substantially near under the free arm of the second radiating portion, a distal end of the third radiating portion is located above a junction between a front and a rear of the third radiating portion and substantially apart in front of the other arm of the second radiating portion, wherein the other end of the first radiating portion is apart from the third radiating portion.

As described above, the built-in multi-band antenna has a simplified structure and a miniaturized volume by virtue of the substantially lying U-shaped first radiating portion of which one end is connected with the rear end of the first side edge of the base portion, the other end is apart from the third radiating portion, and the mouth faces to the first side edge of the base portion, the substantially lying L-shaped second radiating portion connected with the front end of the second side edge of the base portion with the free arm thereof extending rearward, and the third radiating portion tortuously extending downward from the front edge of the base portion, then extending transversely to be located substantially in front of the other arm of the second radiating portion, and further circuitously extending rearward to be located substantially near under the free arm of the second radiating portion, the distal end of the third radiating portion being located above the junction between the front and the rear of the third radiating portion and substantially apart in front of the other arm of the second radiating portion. As a result, the multi-band antenna is appropriate to a portable mobile communication device being developed towards a miniaturized direction so as to be conveniently assembled in the portable mobile communication device and lower a manufacture cost of the multi-band antenna. Furthermore, the first radiating portion resonates at a first frequency range covering 1710 MHz to 2170 MHz, the second radiating portion resonates at a second frequency range covering 1450 MHz to 1510 MHz, and the third radiating portion resonates at a third frequency range covering 824 MHz to 960 MHz to make the multi-band antenna obtain the frequency range corresponding to the multiple bands.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
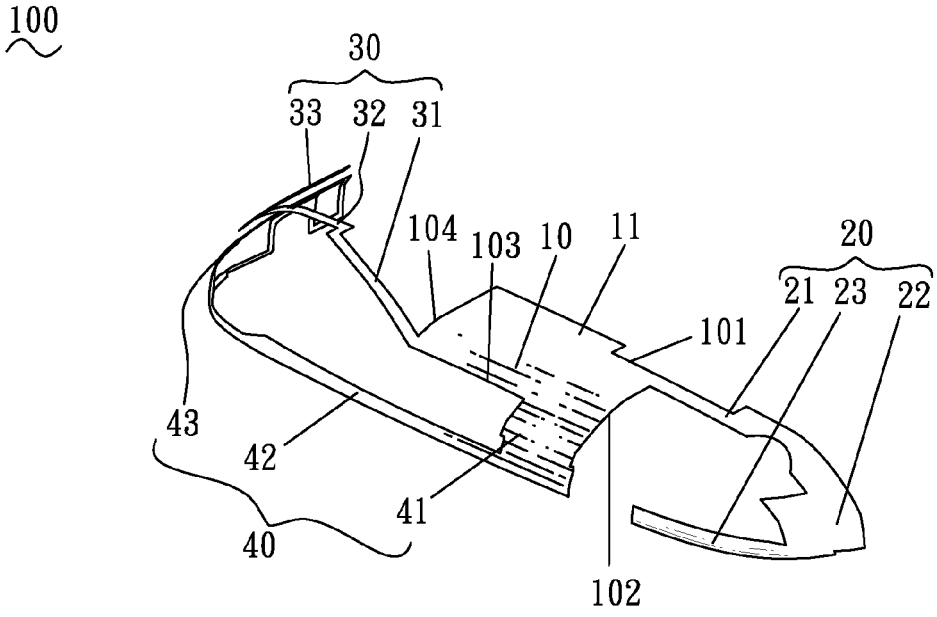
FIG. 1 is a perspective view of a multi-band antenna in accordance with an embodiment of the present invention.

Referring to FIG. 1, a multi-band antenna 100 in accordance with an embodiment of the present invention is shown. The multi-band antenna 100 is formed by LDS (Laser Direct Structuring) technology. The multi-band antenna 100 includes a base portion 10, a first radiating portion 20, a second radiating portion 30 and a third radiating portion 40.

Referring to FIG. 1, the base portion 10 is of a substantially rectangular plate shape and disposed horizontally and extended transversely. The base portion 10 has a rear edge 101, a front edge 103 parallel to the rear edge 101, and a first side edge 102 and a second side edge 104 respectively connected between the rear edge 101 and the front edge 103. One side of the rear edge 101 of the base portion 10 extends rearward to form a ground portion 11. A top of the base portion 10 defines a feeding point (not shown) adjacent to the rear edge 101 and the first side edge 102 of the base portion 10. A top of the ground portion 11 defines a ground point (not shown) adjacent to the second side edge 104 of the base portion 10 and away from the front edge 103 of the base portion 10. One longitudinal edge of the ground portion 11 is connected with and in alignment with the second side edge 104 of the base portion 10.

Figure 2:
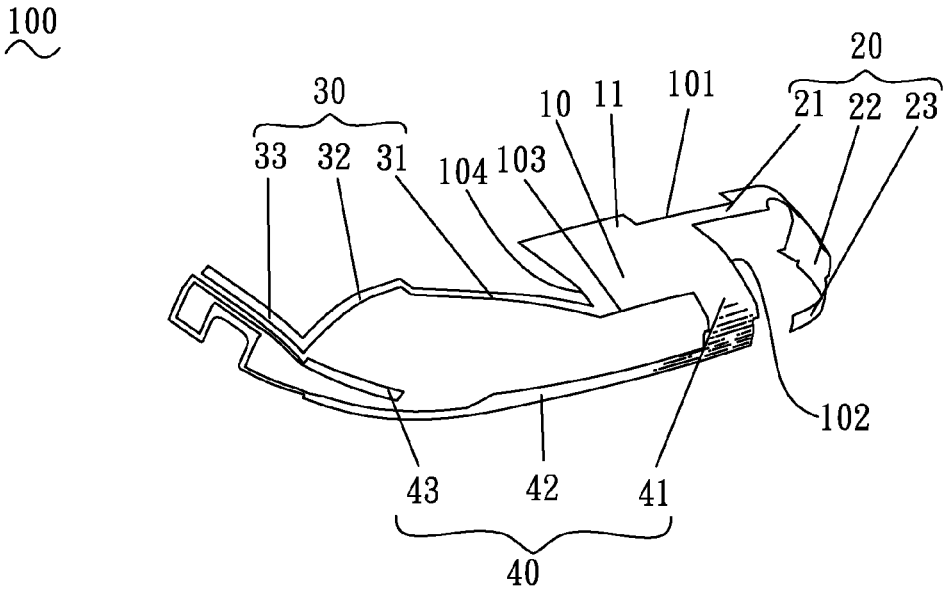
FIG. 2 is another perspective view of the multi-band antenna in accordance with the embodiment of the present invention.

Referring to FIG. 2, the second radiating portion 30 is of a substantially lying L-shape and connected with a front end of the second side edge 104 of the base portion 10 with a free arm thereof extending rearward. The second radiating portion 30 includes an elongated second extension section 31, a second connection section 32 and a second bending portion 33. The front end of the second side edge 104 of the base portion 10 slantwise extends rearward to form the second extension section 31. A free end of the second extension section 31 is bent rearward and then extending substantially opposite to the base portion 10 with being curved downward to form the second connection section 32. A free end of the second connection section 32 extends rearward to form the second bending portion 33. The free arm of the second radiating portion 30 is namely the second bending portion 33, and the other arm of the second radiating portion 30 is namely the second extension section 31 and the second connection section 32.

Referring to FIG. 1, the third radiating portion 40 is coplanar with the base portion 10 and is connected with the front edge 103 of the base portion 10. The third radiating portion 40 includes a third extension section 41, a third connection section 42 and a third bending section 43. One side of the front edge 103 of the base portion 10 adjacent to the first side edge 102 of the base portion 10 is spread forward and then tortuously extends downward to form the third extension section 41. A bottom of the third extension section 41 extends transversely and parallel to the front edge 103 of the base portion 10, and then is bent rearward to form the third connection section 42 located substantially in front of the other arm of the second radiating portion 30. A free end of the third connection section 42 circuitously extends rearward, and then is folded forward to form the third bending section 43 located substantially near under the free arm of the second radiating portion 30. A distal end of the third bending section 43 of the third radiating portion 40 is located above a junction between the third connection section 42 disposed at a front of the third radiating portion 40 and the third bending section 43 disposed at a rear of the third radiating portion 40 and substantially apart in front of the other arm of the second connection section 32 of the second radiating portion 30.

Referring to FIG. 1, the first radiating portion 20 is of a substantially lying U-shape. One end of the first radiating portion 20 is connected with a rear end of the first side edge 102 of the base portion 10 and the mouth of the first radiating portion 20 faces to the first side edge 102 of the base portion 10. The other end of the first radiating portion 20 is apart from the third radiating portion 40. The first radiating portion 20 includes an elongated first extension section 21, a first connection section 22 and a first bending portion 23. The rear end of the first side edge 102 of the base portion 10 extends opposite to the third connection section 42 of the third radiating portion 40 and then is bent downward to form the elongated first extension section 21. A free end of the first extension section 21 is further bent downward, and then is spread forward to form the first connection section 22 with a bottom end thereof further curved towards a bottom of the first extension section 21. A front rim of the bottom end of the first connection section 22 is curvedly elongated towards the third radiating portion 40 to form the first bending portion 23.

When the multi-band antenna 100 is used in wireless communication, the multi-band antenna 100 is assembled in a portable mobile communication device (not shown) and an electric current is fed into the built-in multi-band antenna 100 via the feeding point. The first radiating portion 20 resonates at a first frequency range covering 1710 MHz to 2170 MHz, the second radiating portion 30 resonates at a second frequency range covering 1450 MHz to 1510 MHz, and the third radiating portion 40 resonates at a third frequency range covering 824 MHz to 960 MHz to make the multi-band antenna 100 obtain the frequency range corresponding to the multiple bands. Therefore, the multi-band antenna 100 obtains the frequency range corresponding to global system for mobile communications (GSM) band ranged between 824 MHz and 894 MHz and ranged between 880 MHz and 960 MHz, digital cellular system (DCS) band ranged between 1710 MHz and 1880 MHz, personal communication services (PCS) band ranged between 1850 MHz and 1990 MHz, code division multiple access (CDMA) band ranged between 1470 MHz and 1510 MHz, and wideband code division multiple access (WCDMA) band ranged between 1920 MHz and 1980 MHz and ranged between 2110 MHz and 2170 MHz in mobile communication.

As described above, the built-in multi-band antenna 100 has a simplified structure and a miniaturized volume by virtue of the substantially lying U-shaped first radiating portion 20 of which one end is connected with the rear end of the first side edge 102 of the base portion 10, the other end is apart from the third radiating portion 40, and the mouth faces to the first side edge 102 of the base portion 10, the substantially lying L-shaped second radiating portion 30 connected with the front end of the second side edge 104 of the base portion 10 with the free arm thereof extending rearward, and the third radiating portion 40 tortuously extending downward from the front edge 103 of the base portion 10, then extending transversely to be located substantially in front of the other arm of the second radiating portion 30, and further circuitously extending rearward to be located substantially near under the free arm of the second radiating portion 30 with the distal end thereof being located above the junction between the front and the rear of the third radiating portion 40 and substantially apart in front of the other arm of the second radiating portion 30. As a result, the multi-band antenna 100 is appropriate to the portable mobile communication device being developed towards a miniaturized direction so as to be conveniently assembled in the portable mobile communication device and lower a manufacture cost of the multi-band antenna 100. Furthermore, the first radiating portion 20 resonates at the first frequency range covering 1710 MHz to 2170 MHz, the second radiating portion 30 resonates at the second frequency range covering 1450 MHz to 1510 MHz, and the third radiating portion 40 resonates at the third frequency range covering 824 MHz to 960 MHz to make the multi-band antenna 100 obtain the frequency range corresponding to the multiple bands.

What is claimed is:

1. A multi-band antenna, comprising:

a base portion having a rear edge, a front edge parallel to the rear edge, and a first side edge and a second side edge respectively connected between the rear edge and the front edge, one side of the rear edge of the base portion extending rearward to form a ground portion with a ground point being defined thereon, a top of the base portion defining a feeding point;

a substantially lying U-shaped first radiating portion of which one end is connected with a rear end of the first side edge of the base portion and the mouth faces to the first side edge of the base portion;

a substantially lying L-shaped second radiating portion connected with a front end of the second side edge of the base portion with a free arm thereof extending rearward; and a third radiating portion tortuously extending downward from the front edge of the base portion, then extending transversely to be located substantially in front of the other arm of the second radiating portion, and further circuitously extending rearward to be located substantially near under the free arm of the second radiating portion, a distal end of the third radiating portion being located above a junction between a front and a rear of the third radiating portion and substantially apart in front of the other arm of the second radiating portion, wherein the other end of the first radiating portion is apart from the third radiating portion.

2. The multi-band antenna as claimed in claim 1, wherein the first radiating portion includes a first extension section extending opposite to the third radiating portion and then bent downward from the rear end of the first side edge of the base portion, a first connection section bent downward and then spread forward from a free end of the first extension section with a bottom end thereof further curved towards a bottom of the first extension section, and a first bending portion curvedly elongated towards the third radiating portion from a front rim of the bottom end of the first connection section.

3. The multi-band antenna as claimed in claim 1, wherein the second radiating portion includes a second extension section slantwise extending rearward from the front end of the second side edge of the base portion, a second connection section bent rearward from a free end of the second extension section and then extending substantially opposite to the base portion with being curved downward, and a second bending portion extending rearward from a free end of the second connection section, the free arm of the second radiating portion is namely the second bending portion, and the other arm of the second radiating portion is namely the second extension section and the second connection section.

4. The multi-band antenna as claimed in claim 1, wherein the third radiating portion includes a third extension section spread forward and then tortuously extending downward from one side of the front edge of the base portion adjacent to the first side edge of the base portion, a third connection section extending transversely and then bent rearward from a bottom of the third extension section to be located substantially in front of the other arm of the second radiating portion, and a third bending section circuitously extending rearward from a free end of the third connection section and then folded forward to be located substantially near under the free arm of the second radiating portion, a distal end of the third bending section is located above a junction between the third connection section formed at the front of the third radiating portion and the third bending section formed at the rear of the third radiating portion.

5. The multi-band antenna as claimed in claim 1, wherein the feeding point is adjacent to the rear edge and the first side edge of the base portion, and the ground point is adjacent to the second side edge of the base portion and away from the front edge of the base portion.

6. The multi-band antenna as claimed in claim 1, wherein the first radiating portion resonates at a first frequency range covering 1710MHz to 2170MHz, the second radiating portion resonates at a second frequency range covering 1450MHz to 1510MHz, and the third radiating portion resonates at a third frequency range covering 824MHz to 960MHz.

* * * * *